US007282251B2

(12) United States Patent
Provost et al.

(10) Patent No.: US 7,282,251 B2
(45) Date of Patent: Oct. 16, 2007

(54) LOOP MATERIALS FOR TOUCH FASTENING

(75) Inventors: George A. Provost, Litchfield, NH (US); William H. Shepard, Amherst, NH (US)

(73) Assignee: Vekro Industries B.V., Caracao (AN)

( * ) Notice: Subject to any disclaimer, the term of this patent is extended or adjusted under 35 U.S.C. 154(b) by 212 days.

(21) Appl. No.: 10/735,447

(22) Filed: Dec. 12, 2003

(65) Prior Publication Data

US 2004/0163221 A1 Aug. 26, 2004

Related U.S. Application Data

(63) Continuation of application No. PCT/US02/18373, filed on Jun. 11, 2002.

(60) Provisional application No. 60/297,500, filed on Jun. 12, 2001.

(51) Int. Cl.
*A44B 18/00* (2006.01)

(52) U.S. Cl. ..... 428/89; 24/450; 24/452

(58) Field of Classification Search ..... 24/442, 24/450, 445–448, 452; 428/99, 67, 100, 428/131–136; 442/85, 88, 89, 105, 113; 604/391

See application file for complete search history.

(56) References Cited

U.S. PATENT DOCUMENTS 3,047,444 A * 7/1962 Harwood ..... 428/153
3,577,607 A 5/1971 Ikoma et al.
3,694,867 A 10/1972 Stumpf
3,705,065 A 12/1972 Stumpf
3,708,361 A 1/1973 Stumpf
3,822,162 A 7/1974 Stumpf
3,940,525 A 2/1976 Ballard
3,949,128 A 4/1976 Ostermeier
4,154,885 A 5/1979 Tecl et al.
4,154,889 A 5/1979 Platt
4,223,059 A 9/1980 Schwarz
4,320,167 A 3/1982 Wishman
4,342,802 A 8/1982 Pickens, Jr. et al.
4,363,845 A 12/1982 Hartmann
4,446,189 A 5/1984 Romanek
4,451,314 A 5/1984 Knoke et al.
4,451,315 A 5/1984 Miyazaki
4,490,425 A 12/1984 Knoke et al.
4,521,472 A 6/1985 Gold
4,600,618 A 7/1986 Raychok, Jr. et al.
4,761,318 A 8/1988 Ott et al.
4,973,326 A 11/1990 Wood et al.
5,032,122 A 7/1991 Noel et al.

(Continued)

FOREIGN PATENT DOCUMENTS

EP 0 341 993 A1 11/1989

(Continued)

*Primary Examiner*—James R Brittain
(74) *Attorney, Agent, or Firm*—Fish & Richardson P.C.

(57) ABSTRACT

Loop materials are provided for touch fastening. The loop materials include a web of nonwoven fibrous material defining a plane, the web including: (a) raised areas, elevated above the plane of the web, defining loops constructed for engagement with male touch fastener elements; (b) rib areas surrounding the raised areas to anchor the loops; and (c) between the rib areas, either open areas, or planar areas that are substantially in the plane of the web.

18 Claims, 6 Drawing Sheets

U.S. PATENT DOCUMENTS 5,066,289 A 11/1991 Polski
5,254,194 A 10/1993 Ott et al.
5,256,231 A 10/1993 Gorman et al.
5,304,162 A 4/1994 Kuen
5,307,616 A 5/1994 Goineau et al.
5,326,612 A 7/1994 Goulait
5,379,501 A 1/1995 Goineau
5,380,313 A 1/1995 Gonlait et al.
5,382,461 A 1/1995 Wu
5,383,872 A 1/1995 Roessler et al.
5,386,595 A 2/1995 Kuen et al.
5,403,302 A 4/1995 Roessler et al.
5,407,439 A 4/1995 Goulait
5,417,902 A 5/1995 Bennie et al.
5,423,789 A 6/1995 Kuen
5,459,991 A 10/1995 Nabeshima et al.
5,470,417 A 11/1995 Goulait
5,476,702 A 12/1995 Datta et al.
5,518,795 A 5/1996 Kennedy et al.
5,531,732 A 7/1996 Wood
5,542,942 A 8/1996 Kline et al.
5,547,531 A 8/1996 Allen et al.
5,554,239 A 9/1996 Datta et al.
5,569,233 A 10/1996 Goulait
5,595,567 A 1/1997 King et al.
5,611,791 A 3/1997 Gorman et al.
5,614,281 A 3/1997 Jackson et al.
5,615,460 A 4/1997 Weirich et al.
5,616,394 A 4/1997 Gorman et al.
5,620,779 A 4/1997 Levy et al.
5,622,578 A 4/1997 Thomas
5,624,427 A 4/1997 Bergman et al.
5,647,864 A 7/1997 Allen et al.
5,669,901 A 9/1997 LaFortune et al.
5,686,163 A * 11/1997 Tsubata et al. ..... 428/99
5,699,593 A 12/1997 Jackson
5,722,968 A 3/1998 Datta et al.
5,736,214 A 4/1998 Billarant
5,763,041 A 6/1998 Leak et al.
5,766,723 A * 6/1998 Oborny et al. ..... 428/100
5,773,120 A 6/1998 Deka et al.
5,814,390 A 9/1998 Stokes et al.
5,830,298 A 11/1998 Jackson
5,843,057 A 12/1998 McCormack
5,858,515 A 1/1999 Stokes et al.
5,888,607 A 3/1999 Seth et al.
5,891,547 A 4/1999 Lawless
5,904,793 A 5/1999 Gorman et al.
5,962,112 A 10/1999 Haynes et al.
5,997,981 A 12/1999 McCormack et al.
6,093,665 A 7/2000 Sayovitz et al.
6,162,522 A * 12/2000 Deka et al. ..... 428/99
6,265,053 B1 7/2001 Kronzer et al.
6,329,016 B1 12/2001 Shepard et al.
6,342,285 B1 1/2002 Shepard et al.
6,368,444 B1 4/2002 Jameson et al.
6,537,935 B1 3/2003 Seth et al.
6,703,086 B2 3/2004 Kronzer et al.
6,756,327 B2 6/2004 Martin
6,955,847 B1 * 10/2005 Itou et al. ..... 428/174
2004/0020579 A1 2/2004 Durrance et al.
2004/0131820 A1 7/2004 Turner

FOREIGN PATENT DOCUMENTS

EP 0 604 731 A1 7/1994
EP 765616 A1 * 4/1997
EP 1 279 348 1/2003
GB 2 285 093 A 6/1995
JP 09003755 A * 1/1997
JP 09-195154 7/1997
WO WO 92/01401 2/1992
WO WO 95/17111 6/1995
WO WO 99/11452 3/1999
WO WO 00/40793 7/2000
WO WO 00/42964 7/2000
WO WO01/80680 1/2001
WO WO 200111130 A1 * 2/2001
WO WO2004/049853 6/2004
WO WO2004/058497 7/2004
WO WO2004/059061 7/2004
WO WO2004/058118 7/2005

* cited by examiner

LOOP MATERIALS FOR TOUCH FASTENING

CROSS-REFERENCE TO RELATED APPLICATIONS

This application is a continuation of International Application No. PCT/US02/18373, filed Jun. 11, 2002 and designating the United States, which claims the benefit under 35 USC §119(e) of provisional Application No. 60/297,500, filed Jun. 12, 2001.

TECHNICAL FIELD

This invention relates to loop materials for touch fastening.

BACKGROUND

This invention relates to loop material, particularly to material to be engaged with hooking members to form a fastening, to its manufacture and use, and to fasteners comprising such loop material.

In the production of woven and non-woven materials, it is common to form the material as a continuous web that is subsequently spooled. In woven and knit loop materials, loop-forming filaments or yarns are included in the structure of a fabric to form upstanding loops for engaging hooks. As hook-and-loop fasteners find broader ranges of application, especially in inexpensive, disposable products, some forms of non-woven materials have been suggested to serve as a loop material to reduce the cost and weight of the loop product while providing adequate closure performance in terms of peel and shear strength. Nevertheless, cost of the loop component has remained a major factor limiting the extent of use of hook and loop fasteners.

To adequately perform as a loop component for touch fastening, the loops of the material must be exposed for engagement with mating hooks. Unfortunately, compression of loop material during packaging and spooling tends to flatten standing loops. In the case of diapers, for instance, it is desirable that the loops of the loop material provided for diaper closure not remain flattened after the diaper is unfolded and ready for use.

Also, the loops generally should be secured to the web sufficiently strongly so that the loop material provides a desired degree of peel strength when the fastener is disengaged, and so that the loop material retains is usefulness over a desired number of closure cycles. The desired peel strength and number of closure cycles will depend on the application in which the fastener is used. For example, a higher number of closure cycles is typically required when the fastener is used in a bag closure than when the fastener is used in a diaper closure.

The loop component should also have sufficient strength, integrity, and secure anchoring of the loops so that the loop component can withstand forces it will encounter during use, including dynamic peel forces and static forces of shear and tension.

SUMMARY

We have realized that non-woven fabrics constructed with certain structural features are capable of functioning well for their intended purpose as hook-engageable loop fabrics, while providing particular advantage in regard to expense of manufacture and other properties.

According to one aspect, the invention features a loop material for touch fastening that includes a web of non-woven fibrous material defining a plane. The web includes (a) raised areas, elevated above the plane of the web, defining loops constructed for engagement with male touch fastener elements; (b) rib areas surrounding the raised areas to anchor the loops; and (c) between the rib areas, planar areas that are substantially in the plane of the web.

According to an alternate aspect of the invention, the web includes, instead of planar areas, open areas (apertures) between the rib areas.

Implementations of the invention may include one or more of the following features. The rib areas include a polymeric reinforcing material. The rib areas extend above the plane of the web. The planar areas include unbonded fibers, i.e., the fibers in the planer areas are substantially unfused. The planar areas are substantially free of polymeric reinforcing material. Alternatively, the planar areas include fibers backed by a layer of polymeric reinforcing material. The rib areas include closed members (closed geometric shapes) that surround the raised areas. The raised areas are polygonal and the closed members include polygons. Alternatively, the raised areas are substantially dome-shaped and the closed members include rings or ellipses. The rib areas further include connecting members extending between the closed members. The closed members and the connecting members together define a network. The open areas and the network define a net material. The web is a carded web. The carded web includes staple fibers. The polymeric reinforcing material is the same material as the fibrous material. At least some of the closed members are tangential to each other.

In a further aspect, the invention features a loop material for touch fastening including a web of nonwoven fibrous material defining a plane, the web including: (a) raised areas, elevated above the plane of the web, defining loops constructed for engagement with male touch fastener elements; and (b) rib areas surrounding the raised areas to anchor the loops, the rib areas having a height of at least 0.003 inch above the plane of the web.

The invention also features methods of forming loop materials.

In one aspect, the invention features a method of forming a loop material for touch fastening. The method includes: (a) passing a nonwoven web through a nip between a flat roll and an embossing roll; and (b) during step (a), applying pressure to the nonwoven web. The embossing roll includes a patterned surface comprising depressions, grooves and lands which correspond, respectively, to raised areas, rib areas and planar or open areas of the loop material, the raised areas defining loops constructed for engagement with male touch fastener elements, and the rib areas surrounding the raised areas to anchor the loops.

Implementations of this aspect of the invention may include one or more of the following features. The non-woven web has a basis weight of less than about 1 osy, more preferably less than about 0.5 osy. The method further includes heating at least one of the rolls to a temperature of from about 250° F. to 400° F. Step (b) is conducted at a pressure of from about 1,000 psi to 20,000 psi, more preferably at least 10,000 psi.

By "hook-engageable" and similar terms used above and throughout this specification, we mean that the loop material defines openings of size adequate to receive the tip or head portion of a male fastener element (such as a hook-shape or mushroom-shape element, for instance) for forming a fastening, and that the openings are exposed and extended for engagement.

The invention can provide an inexpensive loop product which can effectively engage and retain hooks, such as in hook-and-loop fasteners. The loop product can be particularly useful in combination with extremely small, inexpensive molded hooks as fasteners for disposable products, such as diapers, medical devices or packaging. We have found, for instance, that the structure of the material, described below in more detail, helps to prevent permanent flattening of the loops and provides some advantageous crush resistance.

Moreover, the balance of properties of the loop material (e.g., cost, weight, strength and durability) can be easily adjusted, as will be discussed below.

Other features and advantages of the invention will be apparent from the description and drawings, and from the claims.

DETAILED DESCRIPTION

Figure 1:
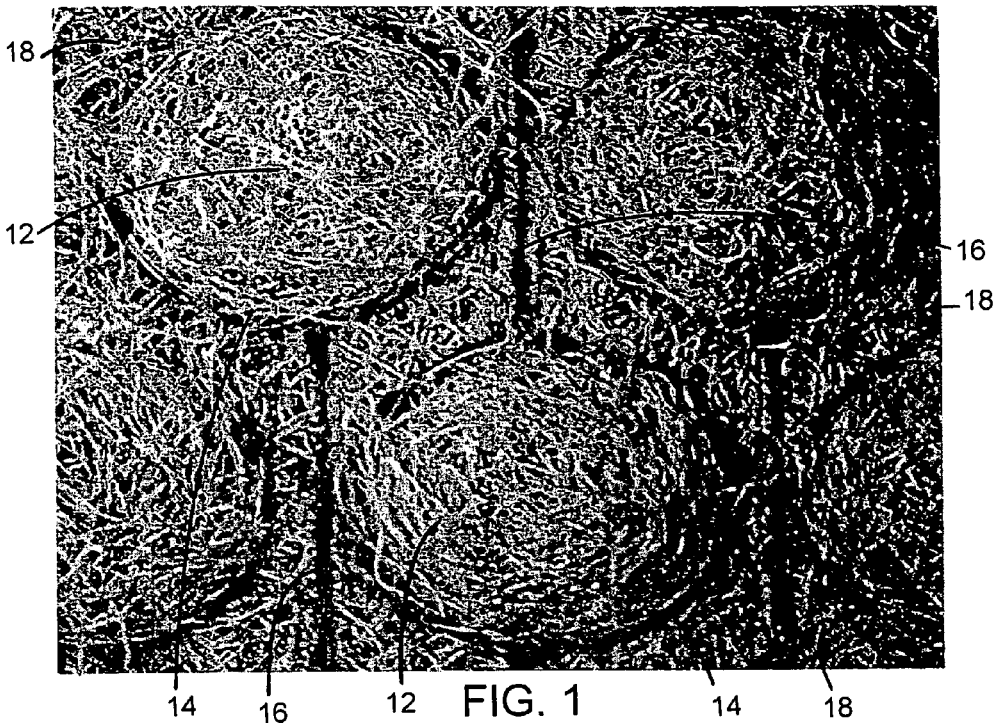
FIG. 1 is a microphotograph of a loop material according to one embodiment of the invention.
Figure 1A:
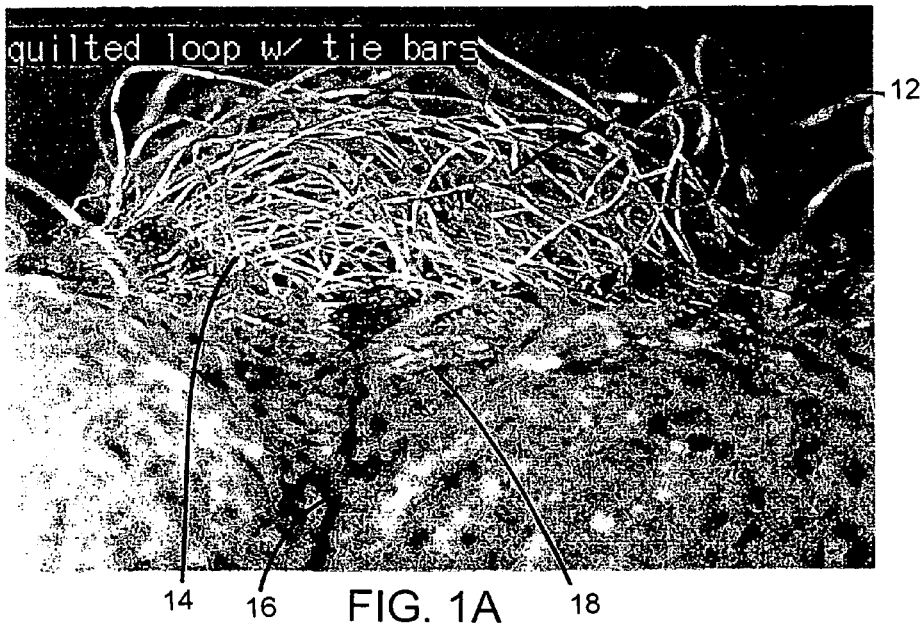
FIG. 1A is a microphotograph showing an enlarged end view of the loop material of FIG. 1.

Preferred loop materials include a nonwoven web having raised areas, elevated above the plane of the web, which define loops constructed for engagement with male touch fasteners. The raised areas provide regions of loose, uncompressed fibers that are capable of being engaged by hooking elements. The raised areas are surrounded by rib areas, which preferably include a bead of polymeric reinforcing material. Portions of the loose fibers are embedded and fixed in the polymeric material and can therefore support loads from the engaging hooks. Between the rib areas lie other areas which may either be open areas, or planar areas of the nonwoven web, as will be discussed in detail below.

A preferred loop material is shown in FIGS. 1-1A and 2-2B. In this embodiment, the loop material 10 includes raised areas in the form of loop domes 12, ring-shaped rib areas 14 surrounding the loop domes 12, and connecting rib areas 16 extending between the ring-shaped rib areas 14. Between the rib areas 14, 16 lie planar areas 18 of compressed fibers. The planar areas 18 lie substantially in the plane of the web, and are not intended for engagement with hook members.

In the embodiment shown in FIGS. 1-1A and 2-2B, the loop material 10 may be formed by passing a lightweight nonwoven web and a polymeric film layer through an embossing roll under pressure, as will be discussed in further detail below. The embossing roll includes channels corresponding to the rib areas 14, 16, along which the polymer of the film layer can flow in response to the applied pressure. As a result, the polymer provided by the film layer migrates preferentially into the rib areas, leaving the planar areas and loop domes relatively free of polymer. The highly compressed fibers in the planar areas are lightly bonded to each other by the remaining polymer, producing a very thin and flexible film in this area. The displacement of most of the polymer into the rib areas creates an overall flexible fabric.

The ratio between the planar areas and raised areas may be adjusted to produce plastic ridges of sufficient dimension to be an effective fiber anchor using a polymeric film of any desired thickness. A high ratio of planar areas to raised areas ensures good fiber anchoring, but reduces the amount of available hook engaging fibers. The planar areas should comprise less than less than 50% of the total surface area of the loop material, preferably less than 25%, and more preferably less than 10%.

Figure 2A:
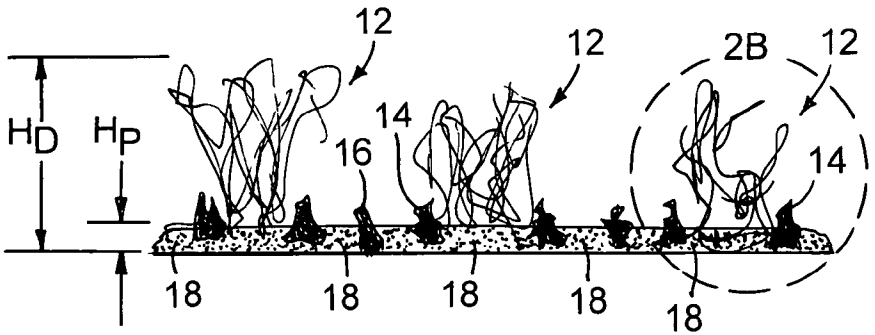
FIG. 2A is an enlarged schematic cross-sectional view of the loop material of FIG. 2, taken along line A-A.
Figure 2B:
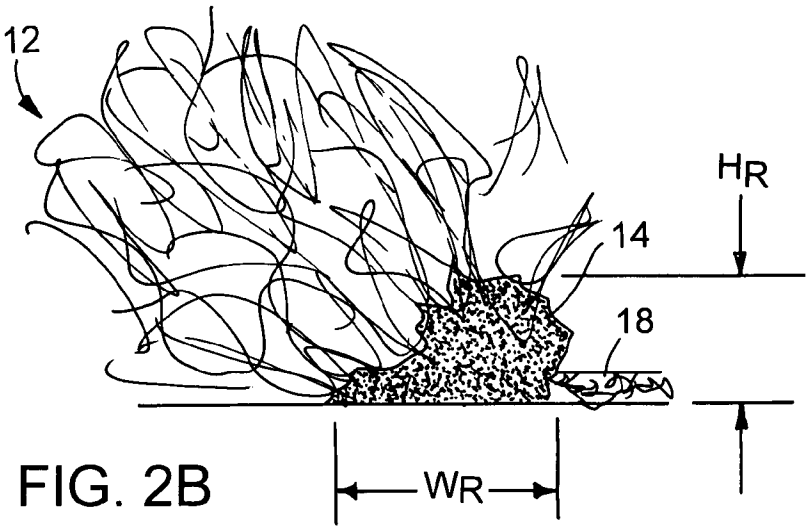
FIG. 2B is a further enlarged detail view of area B of FIG. 2A.
Figure 2:
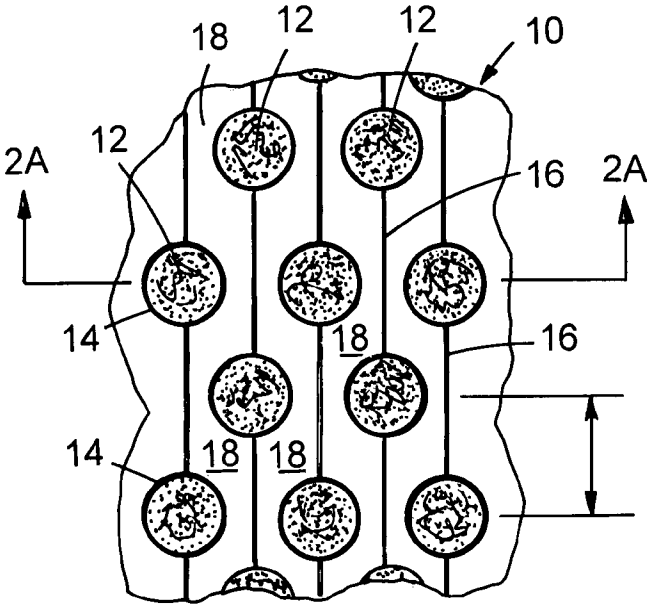
FIG. 2 is a schematic plan view of the loop material shown in FIG. 1.

Referring to FIGS. 2A and 2B, the loop domes preferably have a height $H_D$ of from about 0.030 to 0.100 inch. The ring-shaped rib areas preferably have a height $H_R$ of from about 0.003 to 0.030 inch, and a width $W_R$ of from about 0.003 to 0.030 inch. The planar areas preferably have a height $H_P$ of from about 0.003 to 0.010 inch. Referring to FIG. 3B, the connecting ribs 16 have a height Hc of from about 0.003 to 0.030 inch, and a width Wc at the base of from about 0.003 to 0.030 inch.

Figure 3:
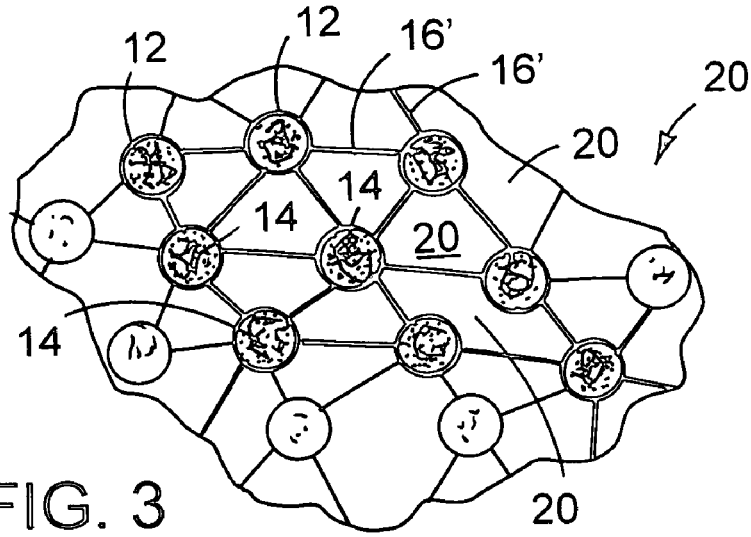
FIG. 3 is a schematic plan view of a loop material according to another embodiment of the invention, in which the loop material includes connecting ribs.
Figure 3A:
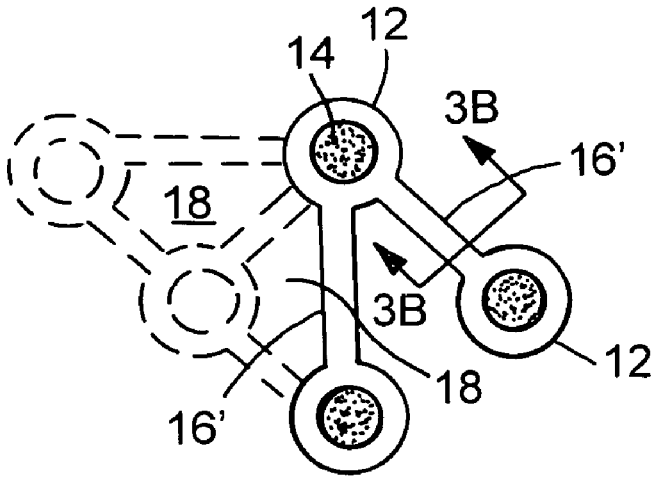
FIG. 3A is an enlarged detail view of a portion of the material shown in FIG. 3.
Figure 3B:
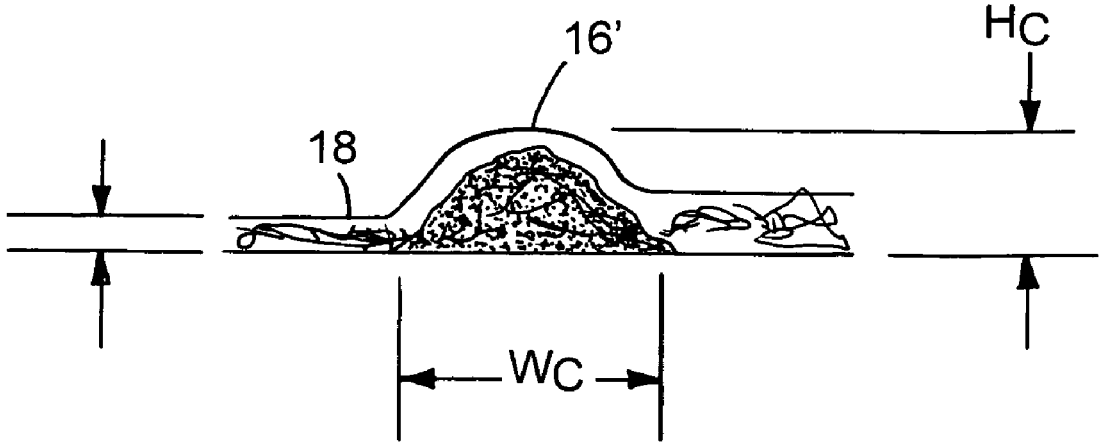
FIG. 3B is a cross-sectional view of a single rib, taken along line B-B in FIG. 3A.

In an alternate embodiment, shown in FIG. 3, loop material 20 includes loop domes 12 and rib areas 14, as discussed above. In this embodiment, however, the connecting rib areas 16' connect every loop dome to all six adjoining loop domes, and the areas 20 in between the rib areas 14, 16 are open, rather than planar. In this case, all of the material between the rib areas, both fibers and polymer, has been forced into the rib areas, leaving an open net loop material. This material is lightweight, breathable and may in some cases be stretchable.

The multiple connecting rib areas 16', shown in FIG. 3, can also be used in embodiments in which the areas between the rib areas are planar fiber areas, rather than open areas.

Figure 5:
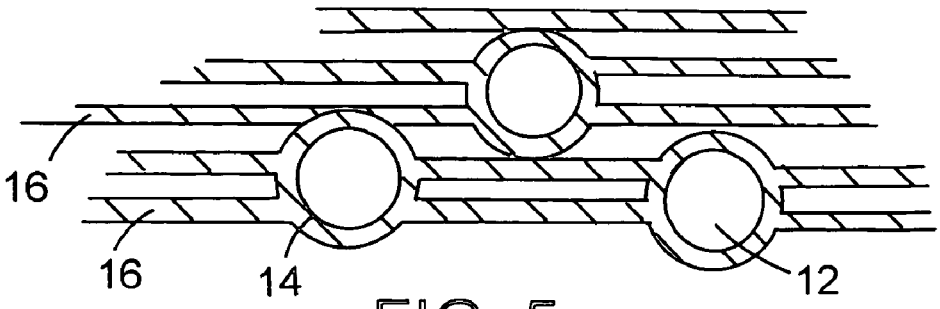

In an alternate embodiment, shown in FIG. 5, the loop material includes multiple parallel connecting rib areas 16. When multiple connecting rib areas are used, the polymer does not need to be displaced as far as is necessary to form the single connecting rib structure shown in FIG. 1. This arrangement can be accomplished by using more resin than is used for the single connecting rib structure, and/or by making the multiple connecting ribs lower than the single connecting ribs, depending upon how much strength is required.

Figure 4:
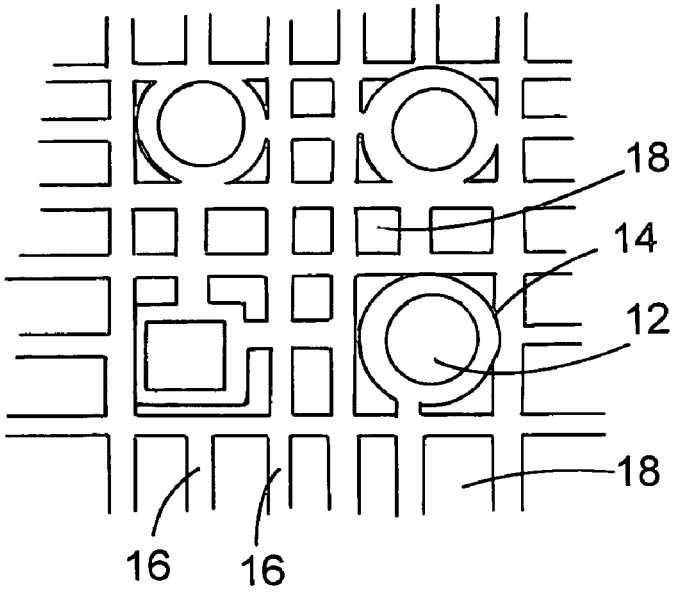
FIGS. 4 and 5 are schematic plan views of loop materials according to other alternate embodiments of the invention.

The connecting ribs can also form a cross-hatch pattern with either round or square loop domes, e.g., as shown in FIG. 4.

Suitable nonwoven webs include carded webs, spunbonded webs, air-laid webs, hydroentangled webs, meltblown webs, wet-laid webs, and needled webs. The nonwoven web may be formed of staple fibers or continuous fibers.

Generally, carded webs formed of staple fibers are preferred. It is also preferred that the web have a low basis weight, preferably less than 1 ounce/yd$^2$ (osy), more preferably less than 0.5 osy. Low basis weight webs also have a low fiber density. This produces a very open fiber structure in the raised areas that enables hook elements to easily penetrate and engage the fibers.

Staple fibers are preferred because the strength or tenacity of each fiber is generally higher for a given fiber diameter than in nonwoven webs made from spunbonded or melt blown fibers. Also, staple fibers are available in a wider range of types and sizes, allowing more flexibility in designing a loop material with a desired balance of properties.

The preferred carded webs may be produced using methods well known to those familiar with carding technology. Preferred webs include staple fibers of 2 to 10 deniers, more preferably 3 to 6 deniers. The fibers are typically 1 to 6 inches in length, preferably 2 to 4 inches. Thus, the preferred fiber length is significantly greater than the preferred diameters of the loop domes 12. As a result, a single fiber will generally be anchored by several of the ring-shaped rib areas 14, resulting in secure anchoring of the fiber, and will be present in several loop domes 12.

Suitable fiber resins include polyester, polyethylene, polypropylene, nylon and other thermoplastics. The fibers can be formed of a single resin or a combination of two or more resins. If a combination of resins is desired, this can be provided as a blend of single-component fibers, or as bicomponent fibers produced by co-extrusion, e.g., so that one resin forms a sheath around the other resin.

When the nonwoven web is processed to form the loop material, the nonwoven web may be supported by a polymeric film, as discussed above, or unsupported. The polymeric film may be a thin thermoplastic film such as polyethylene, polypropylene, or polyvinyl chloride (PVC). The film thickness is preferably from about 0.0005 to 0.005 inches, more preferably from 0.001 to 0.003 inches.

The nonwoven web, either supported or unsupported, is passed through the nip of a high pressure heated set of calendar rolls. One of the rolls has a smooth flat surface and the other roll, the embossing roll, has a patterned surface comprising depressions, grooves, and lands which correspond, respectively, to the loop domes 12, connecting ribs 16 and planar or open areas 18 of the finished product. As the web passes through the nip, molten resin in the flat areas is forced into the grooves and forms the network of ribs 16 that interconnect the loop domes. It is generally not necessary to provide grooves around the depressions to form the ring-shaped ribs; resin will flow from the flat areas around the inner periphery of the depressions, forming the ring-shaped ribs.

The depth of the grooves will correspond to the desired height of the ribs, assuming that there is enough material to fill the grooves and sufficient pressure is applied at the nip. Generally, the depth D of the grooves (FIG. 6B) is between 0.003 to 0.030 inches. The width W of the grooves corresponds to the width of the connecting ribs at their top surface, again assuming that the grooves completely fill with resin.

Figure 6:
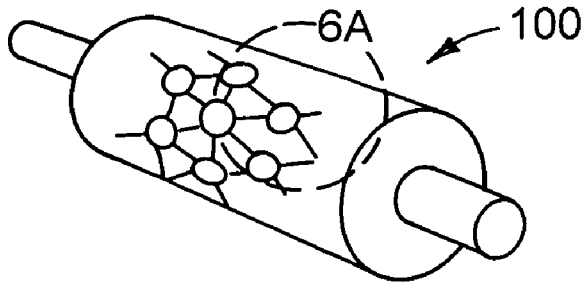
FIG. 6 is a perspective view of an embossing roll used in manufacturing the loop material shown in FIG. 3.
Figure 6A:
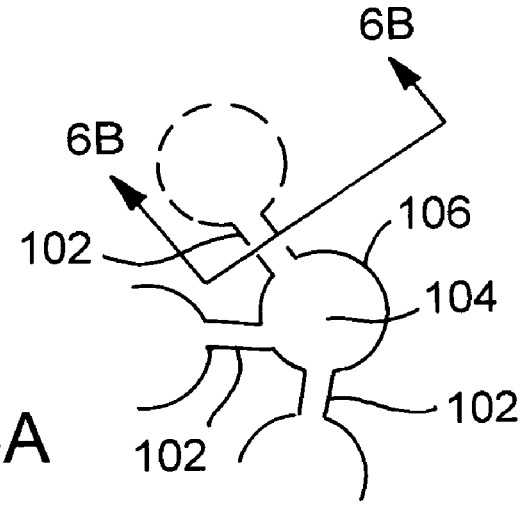
FIG. 6A is a highly enlarged view of detail A in FIG. 6.
Figure 6B:
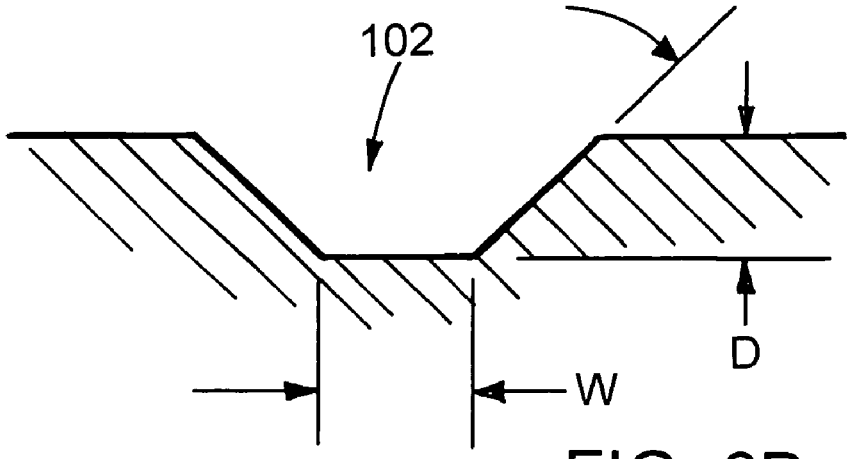
FIG. 6B is a partial cross-sectional view taken along line B-B in FIG. 6A.

FIGS. 6-6B show an embossing roll 100, which is suitable for making the product shown in FIG. 3. Embossing roll 100 includes dome-shaped depressions 102, grooves 104, and lands 106. The grooves 104 can have the profile shown in FIG. 6B. This is generally the easiest shape to machine.

Figure 7:
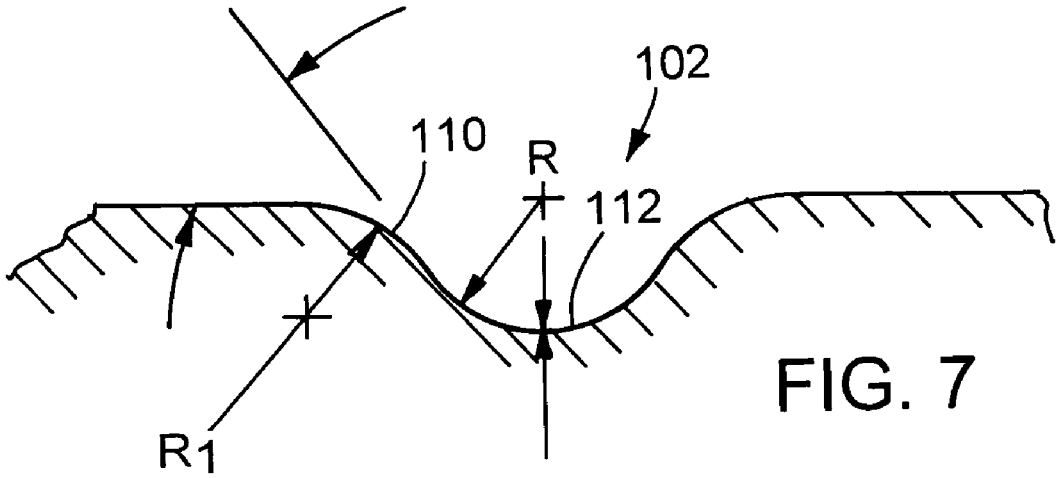
FIGS. 7 and 8 are partial cross-sectional views similar to that shown in FIG. 6B, but showing alternate geometries for the roll surface.
Figure 8:
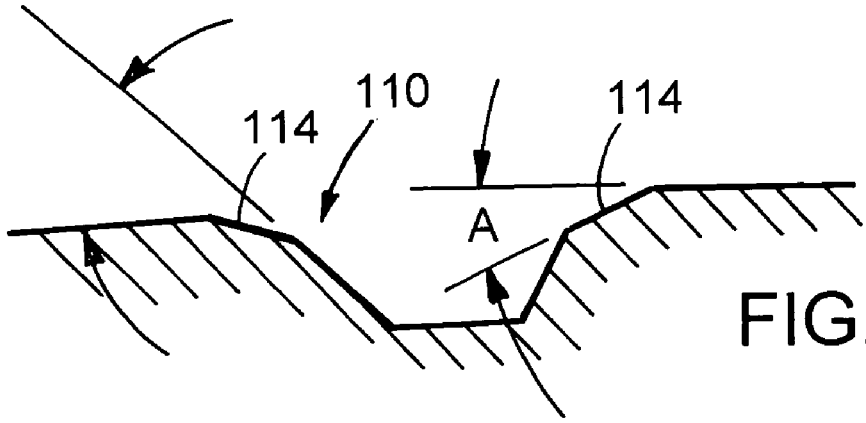

Alternatively, the grooves 104 can have a semi-circular cross-sectional profile, as shown in FIG. 7, or a profile similar to that in FIG. 6B but with radiused or chamfered edges, as shown in FIG. 8. The transition region between the rib areas and the planar areas may in some cases be sensitive to rupture, in which case the geometries shown in FIGS. 7 and 8, in which a transition zone (a softened edge such as a radius or compound radius) is provided, are preferred.

In FIG. 7, the curved top edge 110 of groove 102 has a transition radius $R_T$. The inside surface 112 of the groove is also curved, with a radius of curvature R. In FIG. 8, the top edge 110 of groove 102 includes a chamfered surface 114, which provides a transition angle A.

Alternatively, some other form of tooling relief or approach angle may be used in that area to accomplish the same purpose.

The temperature of the rolls and the pressure they apply will depend on the softening temperatures of the web fiber resin(s) and the polymeric film, if one is used. These parameters are adjusted to achieve the proper melt of the resin that will form the rib areas, without damaging the integrity or the functionality of the fibers in the raised areas. Different temperatures might also be required on the flat and patterned rolls to achieve the desired results. Typical temperatures can range from 250° F. to 400° F. or more, depending on process speed, and pressures from 1,000 psi to 20,000 psi or more, preferably at least 10,000 psi.

Examples of suitable combinations of materials include the following: (1) a carded web of polyester fibers with a melt temperature of 485° F. and a support film of polyethylene that melts at 275° F.; (2) a carded web of polyester fibers with a melt of 485° F. blended with 25% polyethylene fibers that melt at 275° F., with no support film; (3) a carded web of a co-extruded polyester fiber with an outer shell of polyester with a melt of 285° F. and a core of a polyester with a melt of 485° F. In all of these examples there is a substantial melt temperature differential between the two resins in the overall structure. This allows a broader acceptable range of temperature and pressure.

Alternatively, the web can be made entirely of a single type fiber, and the web itself can be used as the resin that forms the rib regions. This alternative will require more precise control over temperature and pressure. In this case, the transition between the ribs and planar areas tends to be particularly sensitive to rupture, and thus it is preferred that the groove geometry shown in FIG. 7 be used.

In addition to, or instead of, selecting fibers and films of different melt temperatures, resins having different hardness characteristics can achieve similar anchoring effects. Relatively softer materials can flow to form rib areas and encapsulate harder fibers under high pressures, without requiring elevated temperatures during the embossing process. Eliminating heating will reduce the potential thermal damage to the hook engaging fibers.

The geometry of the patterned roll can be selected to produce a desired end result. The domes and grooves can have any desired shape. The depressions must merely be deep enough to prevent excessive compression of the fibers or other damage to the functional fiber domes they produce. The spacing or lands between these depressions are designed such that, under the appropriate temperature and pressure for the chosen resins, they displace molten plastic into the grooves, as discussed above.

The properties of the loop material can be relatively easily adjusted, by adjusting the amount of reinforcing resin used and/or changing the depth, number and/or arrangement of the rib members. If more resin is used, the loop material will generally be stronger, but also will be more expensive and heavier. If more rib members and/or thicker rib members are used, this will also generally increase the strength of the loop material. Thus, in applications where high strength is not needed, the loop material can be engineered to be low cost and lightweight, while if high strength is required the loop material can be engineered to provide this property.

Other embodiments are within the scope of the following claims.

For example, the closed rib areas surrounding the raised areas have been shown as ring-shaped. However, these rib areas can have any desired shape, e.g., octagonal, square, triangular or diamond-shaped. Moreover, while the connecting rib areas have been shown as linear, if desired they could be curved or have any desired shape.

Additionally, one or more additional layers can be applied to the loop material, e.g., in a post-process, for reinforcement or to provide other desired properties. Suitable additional layers include reinforcing scrims, glass filaments, pressure sensitive adhesives, and foams. These layers can be applied by any suitable method, e.g., by coating, laminating, or adhering.

What is claimed is:

1. A loop material for touch fastening comprising:

a web of nonwoven fibrous material defining a plane, the web including:

(a) raised areas defined by fibers of the web, the raised areas being elevated above the plane of the web and defining loops constructed for engagement with male touch fastener elements;

(b) rib areas surrounding the raised areas to anchor the loops; and (c) between the rib areas, planar areas that are substantially in the plane of the web, the planar areas being defined by the web.

2. A loop material for touch fastening comprising:

a web of nonwoven fibrous material defining a plane, the web including:

(a) raised areas elevated above the plane of the web, defining loops constructed for engagement with male touch fastener elements;

(b) rib areas surrounding the raised areas to anchor the loops; and (c) between the rib areas, open areas that are free of fibers of the web.

3. The loop material of claim 1 or 2 wherein said rib areas comprise a polymeric reinforcing material.

4. The loop material of claim 3 wherein said polymeric reinforcing material is the same material as the fibrous material.

5. The loop material of claim 1 or 2 wherein said rib areas extend above the plane of the web.

6. The loop material of claim 1 or 2 wherein said rib areas comprise closed members that surround said raised areas.

7. The loop material of claim 6 wherein said raised areas are polygonal and said closed members comprise polygons.

8. The loop material of claim 6 wherein said raised areas are substantially dome-shaped and said closed members comprise rings or ellipses.

9. The loop material of claim 6 wherein at least some of said closed members are tangential to each other.

10. The loop material of claim 6 wherein said rib areas further comprise connecting members extending between said closed members.

11. The loop material of claim 10 wherein said closed members and said connecting members together define a network.

12. The loop material of claim 1 or 2 wherein the web comprises a carded web.

13. The loop material of claim 12 wherein said carded web comprises staple fibers.

14. The loop material of claim 2 wherein said rib areas comprise closed members that surround said raised areas and connecting members extending between said closed members, said closed members and said connecting members together define a network defining a net material.

15. The loop material of claim 1 wherein said planar areas comprise unbonded fibers.

16. The loop material of claim 1 or 15 wherein said planar areas comprise fibers backed by a layer of a polymeric reinforcing material.

17. The loop material of claim 1 or 15 wherein said planar areas are substantially free of polymeric reinforcing material.

18. A loop material for touch fastening comprising:

a nonwoven web defining a plane, the web including:

(a) raised areas, elevated above the plane of the web, defining loops constructed for engagement with male touch fastener elements;

(b) rib areas surrounding the raised areas to anchor the loops; and (c) between the rib areas, planar areas that are substantially in the plane of the web, wherein the rib areas comprise fused fibers of the nonwoven web.

* * * * *

UNITED STATES PATENT AND TRADEMARK OFFICE

CERTIFICATE OF CORRECTION

PATENT NO. : 7,282,251 B2
APPLICATION NO. : 10/735447
DATED : October 16, 2007
INVENTOR(S) : George A. Provost et al.

It is certified that error appears in the above-identified patent and that said Letters Patent is hereby corrected as shown below:

On the title page Under (73) Assignee: --Vekro Industries B.V., Caracao (AN)-- should be "Velcro Industries B.V., Curacao (AN)"

Signed and Sealed this

Seventeenth Day of February, 2009

JOHN DOLL
*Acting Director of the United States Patent and Trademark Office*